US005173733A

United States Patent [19]

Green

[11] Patent Number: 5,173,733

[45] Date of Patent: Dec. 22, 1992

[54] METHOD AND APPARATUS FOR DISABLING DEFECTIVE SECTIONS ON A PHOTORECEPTOR IN AN ELECTROPHOTOGRAPHIC PRINTER

[75] Inventor: Victor R. Green, Hitchin, United Kingdom

[73] Assignee: Xerox Corporation, Stamford, Conn.

[21] Appl. No.: 802,672

[22] Filed: Dec. 5, 1991

[30] Foreign Application Priority Data

Dec. 10, 1990 [GB] United Kingdom ..... 90267709

[51] Int. Cl.[5] ..... G03G 15/00

[52] U.S. Cl. ..... 355/208; 355/212

[58] Field of Search ..... 355/204, 205, 206, 207, 355/208, 212, 203; 358/300

[56] References Cited

U.S. PATENT DOCUMENTS 3,912,390 10/1975 van Herten ..... 355/208

4,556,311 12/1985 Tagoku ..... 355/212

4,630,129 12/1986 Hayashi et al. ..... 358/300 X 4,965,613 10/1990 Morris et al. ..... 355/208 X 5,077,576 12/1991 Stansfield et al. ..... 355/212

FOREIGN PATENT DOCUMENTS 61-292646 12/1986 Japan ..... 355/208

*Primary Examiner*—Joan H. Pendegrass

[57] ABSTRACT

In an electrophotographic apparatus, electrostatic latent images are formed on an endless photoreceptor belt for subsequent development by toner particles and transfer of the toner image to output sheets. The belt has at least two identifiable sections around its length on which images are formed. If a defect occurs in one of the belt sections, the defective belt section may be disabled, so that the formation of images on that section is prevented, while images may be formed on at least one remaining belt section.

9 Claims, 4 Drawing Sheets

METHOD AND APPARATUS FOR DISABLING DEFECTIVE SECTIONS ON A PHOTORECEPTOR IN AN ELECTROPHOTOGRAPHIC PRINTER

FIELD OF THE INVENTION

This invention relates to an electrophotographic apparatus and method in which electrostatic latent images are formed on an endless photoreceptor belt for subsequent development by toner particles and transfer of the toner image to output sheets, the belt having at least two identifiable sections around its length on which said images are formed.

BACKGROUND OF THE INVENTION

In the field of electrophotography, and particularly in xerographic copying machines and laser printers, over recent years there have been moves towards the use of endless belt photoreceptors, rather than rigid drum photoreceptors. Endless belts can be formed by taking a long strip-like substrate, cutting it into lengths and forming each length into an endless belt by joining the two ends. Such a belt can either carry a photoconductive coating before it is seamed, or it can be coated subsequently. Alternatively, endless belts can be formed by coating a plastics material onto a cylindrical mandrel, and removing the (seamless) belt from the mandrel when the plastics material has solidified or consolidated. The plastics material, and the photoconductive layer thereon, may be formed by liquid, vapor or powder deposition techniques.

If the belt has a seam, it is not possible to form an image at the seam position and the images are arranged in fixed positions around the belt to avoid the seam. A mechanism is provided to indicate the seam position and to synchronize the images to predetermined areas or 'panels' on the belt surface. In small copiers or printers such as the Xerox 5046 there may be only two such panels around the circumference of the belt but in larger machines there may be more. The Xerox 5090, for example, has seven panels.

Even if a seamless belt is used, it is often provided with synchronizing features (e.g. holes) to check the speed and position of the belt, and the images may be formed in predetermined positions in relation to these synchronizing features. Thus a copier or printer which uses a belt photoreceptor will typically have one or more synchronizing marks, such as holes, along the border of the belt, outside the imaging area, for controlling the belt during the image forming process. U.S. Pat. No. 3,912,390 discloses a copier in which a series of detectable marks on a photoreceptor belt are used to define a succession of belt panels on the belt, on each of which an image may be formed.

If one of the image forming regions is damaged or contaminated, a defective print will be produced every time this area is used and a maintenance call will be requested by the user. The number of defective prints produced may render the apparatus unusable until the photoreceptor has been repaired or replaced.

It is an object of the present invention to minimize the inconvenience caused by the need to replace a photoreceptor belt once a defect has been noticed.

SUMMARY OF THE INVENTION

The invention accordingly provides an electrophotographic apparatus of the kind specified in the first paragraph hereof which is characterized by means for preventing the formation of images on at least one of said sections, so that a defective belt section may be disabled, while allowing images to be formed on at least one remaining belt section.

Preferably the apparatus includes means for identifying a datum position on the belt, and means for causing the apparatus to operate in a 'test' mode wherein one copy is produced for each of said belt sections, starting with a belt section in a predetermined position relative to said datum position, whereby the belt sections can be identified by the operator of the apparatus.

In another aspect, the invention provides a method of electrophotographic printing in an apparatus in which electrostatic latent images are formed on an endless photoreceptor belt for subsequent development by toner particles and transfer of the toner image to output sheets, the belt having at least two identifiable sections around its length on which said images are formed, characterized by preventing the formation of images on at least one of said sections, so that a defective belt section may be disabled, while allowing images to be formed on at least one remaining belt section.

The apparatus and method of the invention enable the user to determine the position of defective areas on the photoreceptor belt and to input this data to the machine control system so that images are not formed in the identified areas. The apparatus may then be used in this mode with a reduced rate of output until the damaged photoreceptor belt is repaired or replaced by maintenance personnel. If there are n image forming areas on the belt the rate will be reduced to $n-1$ images per revolution. In a small machine with two image areas per belt revolution the output rate would be halved but in a larger machine the reduction in output rate would be small.

BRIEF DESCRIPTION OF THE DRAWINGS

An electrophotographic apparatus and method in accordance with the invention will now be described, by way of example, with reference to the accompanying drawings, in which.

DETAILED DESCRIPTION OF THE INVENTION

Figure 1:
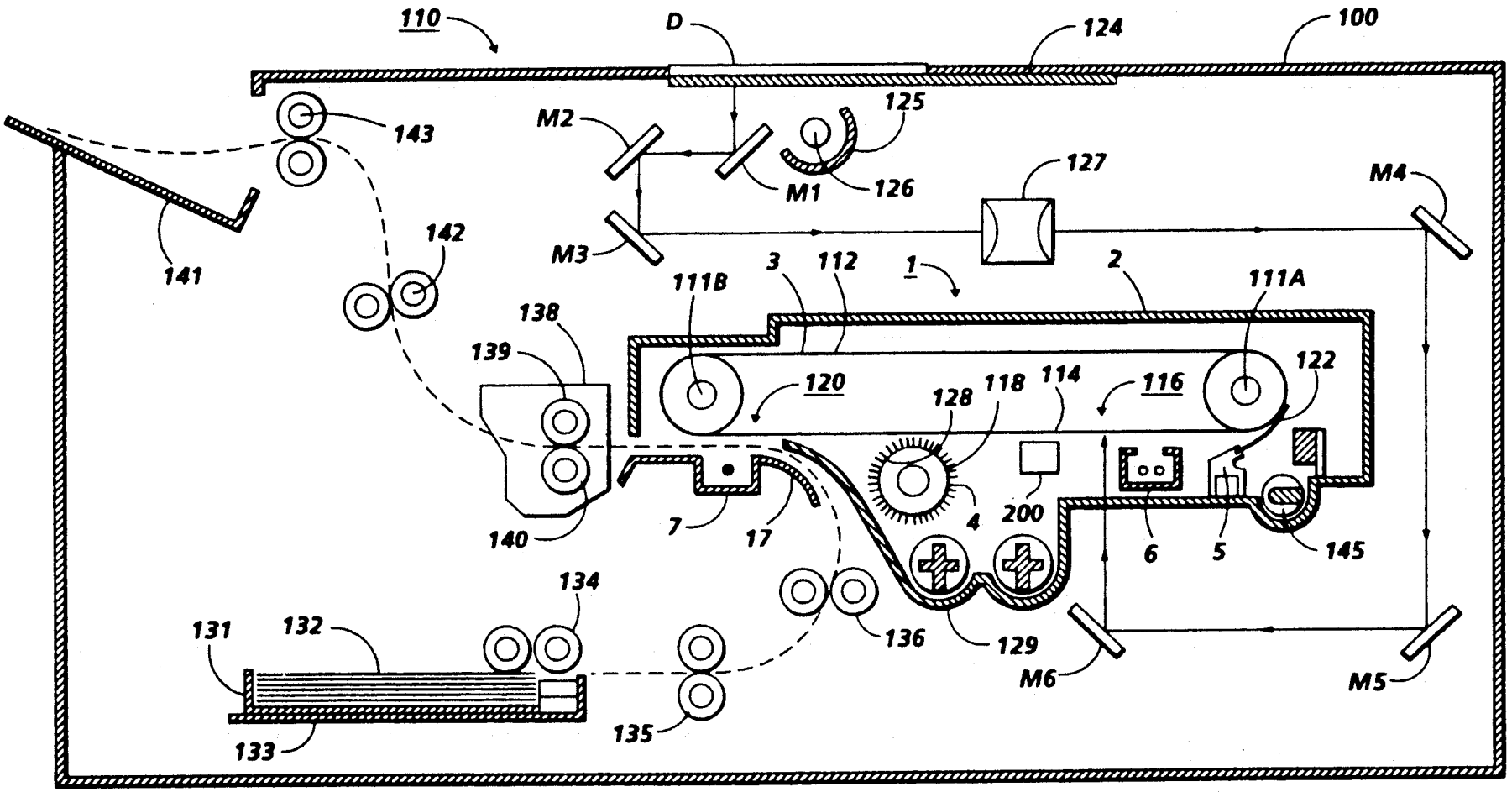
FIG. 1 is a schematic view in cross section of a copying machine which has a cassette containing a photoreceptor belt and which incorporates the present invention.

Referring to FIG. 1 of the drawings, there is shown schematically a xerographic printing machine 110 having a removable xerographic cassette 1 in its operational position in the main assembly 100. The machine includes an endless flexible photoreceptor belt 3 mounted for rotation in the clockwise direction as shown about support rollers 111*a* and 111*b* to carry the photosensitive imaging surface 112 of the belt 3 sequentially through a series of xerographic processing stations, namely a charging station 114, an imaging station 116, a development station 118, a transfer station 120, and a cleaning station 122.

The charging station 114 comprises a corotron 6 which deposits a uniform electrostatic charge on the photoreceptor belt 3. The photoreceptor belt 3, the charge corotron 6, the developer device 4, the transfer corotron 7, and the blade cleaner 5 may all be incorporated in a process cassette 1 adapted to be removably mounted in the main assembly 100 of the xerographic copier as described in U.S. Pat. No. 4,766,455.

An original document D to be reproduced is positioned on a platen 124 and is illuminated in known manner a narrow strip at a time by a light source comprising a tungsten halogen lamp 126. Light from the lamp is concentrated by an elliptical reflector 125 to cast a narrow strip of light on to the side of the original document D facing the platen 124. Document D thus exposed is imaged on to the photoreceptor 3 via a system of mirrors M1 to M6 and a focusing lens 127. The optical image selectively discharges the photoreceptor in image configuration, whereby an electrostatic latent image of the original document is laid down on the belt surface at imaging station 116. In order to copy the whole original document the lamp 126, the reflector 125, and mirror M1 are mounted on a full rate carriage (not shown) which travels laterally at a given speed directly below the platen and thereby scans the whole document. Because of the folded optical path the mirrors M2 and M3 are mounted on another carriage (not shown) which travels laterally at half the speed of the full rate carriage in order to maintain the optical path constant. The photoreceptor belt 3 is also in motion whereby the image is laid down strip by strip to reproduce the whole of the original document as an image on the photoreceptor.

By varying the speed of the scan carriages relative to the photoreceptor belt 3 it is possible to alter the size of the image along the length of the belt, i.e. in the scanning direction. In full size copying, that is to say with unity magnification, the speed of the full rate carriage and the speed of the photoreceptor belt are equal. Increasing the speed of the scan carriage makes the image shorter, i.e. reduction, and decreasing the speed of the scan carriage makes the image longer, i.e. magnification.

The image size can also be varied in the direction orthogonal to the scan direction by moving the lens 127 along its optical axis closer to the original document i.e. closer to mirrors M2 and M3, for magnification greater than unity, and away from the mirrors M2 and M3 for reduction, i.e. magnification less than unity. When the lens 127 is moved, the length of the optical path between the lens and the photoreceptor, i.e. the image distance, is also varied by moving mirrors M4 and M5 in unison to ensure that the image is properly focused on the photoreceptor 1. For this purpose mirrors M4 and M5 are suitably mounted on a further carriage (not shown).

At the development station 118, a magnetic brush developer device with a developer roll 128 develops the electrostatic latent image into visible form. Here, toner is dispensed from a hopper (not shown) into developer housing 129 which contains a two-component developer mixture comprising a magnetically attractable carrier and the toner, which is deposited on the charged area of belt 3 by the developer roll 128.

The developed image is transferred at transfer station 120 from the belt to a sheet of copy paper. The copy paper is delivered into contact with the belt in synchronous relation to the image from a paper supply system 131 in which a stack of paper copy sheets 132 is stored on a tray 133. The top sheet of the stack in the tray is brought, as required, into feeding engagement with a top sheet separator/feeder 134. Sheet feeder 134 feeds the top copy sheet of the stack towards the photoreceptor around a 180° path via two sets of nip roll pairs 135 and 136. The path followed by the copy sheets through the aperture in the cassette is denoted by a broken line. At the transfer station 120 transfer corotron 7 provides the electric field to assist in the transfer of the toner particles thereto.

The copy sheet bearing the developed image is then stripped from the belt 1 and subsequently conveyed to a fusing station 138 which comprises a heated roll fuser 139 to which release oil may be applied in known manner. The image is fixed to the copy sheet by the heat and pressure in the nip between the two rolls 139 and 140 of the fuser. The final copy is fed by the fuser rolls into catch tray 141 via two further nip roll pairs 142 and 143.

After transfer of the developed image from the belt some toner particles usually remain on the surface of the belt, and these are removed at the cleaning station 122 by a cleaner blade 5 which scrapes residual toner from the belt. The toner particles thus removed fall into a receptacle 145 below. Also, any electrostatic charges remaining on the belt are discharged by exposure to an erase lamp which provides an even distribution of light across the photoreceptor surface. The photoreceptor is then ready to be charged again by the charging corotron 6 as the first step in the next copy cycle.

Figure 2:
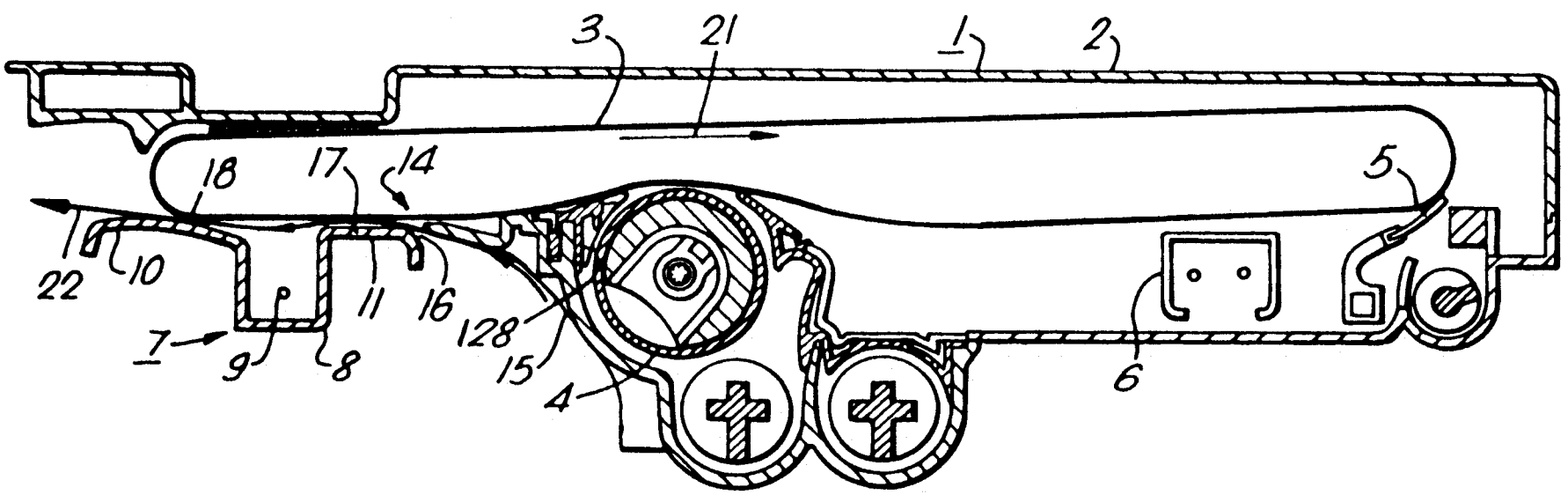
FIG. 2 is a schematic cross section of the cassette of FIG. 1.

The process unit or cassette 1 shown in more detail in FIG. 2 is designed to be removably mounted in the main assembly of a xerographic copier as described, for example, in the aforementioned U.S. Pat. No. 4,766,455, to which reference is invited for further details. The cassette 1 comprises a housing 2 made for example, primarily of polystyrene, which encloses an imaging member in the form of the belt photoreceptor 3 in addition to various process means, in particular the development device 4, cleaner blade 5, and charge corotron 6. These processing means are not directly relevant to the subject matter of the present invention and so no further details are given here except to note that a retractable cleaner blade suitable for this application is the subject of U.S. Pat. No. 4,796,057. The belt photoreceptor is an endless flexible belt having a photosensitive surface. In the arrangement shown, when the cassette 1 is removed from the main assembly of the copier the belt is only loosely retained in the cassette but when the cassette is inserted into the main assembly of the copying machine, the photoreceptor belt is tensioned and supported in an operative position as shown. A cassette having this kind of loosely retained photoreceptor which is tensioned automatically on insertion into the main assembly of the copier forms the subject of the aforementioned U.S. Pat. No. 4,766,455. In operation, the photoreceptor 3 moves in an endless path in the direction of arrow 21.

The transfer charging device 7 is included in the cassette housing in the vicinity of the photoreceptor belt 3 at the area where a toner image is to be transferred from the belt to a copy sheet. The technique of actually transferring a toner image is well known to those skilled in the art and no further details need be given here. The transfer charging device is in the form of a corotron having an outer shield 8 which, as is conventional, is substantially U-shaped and made, for example, of stainless steel. A corona wire 9 extends the full length of the shield 8 and is spaced apart from the walls thereof in the usual manner.

At its upper end the shield has extended portions 10 and 11 on its left and right-hand sides respectively, as viewed in the drawing. These portions 10 and 11 act as guide members and define the path which a copy sheet follows as it passes through the transfer zone of the cassette for the purposes of having a toner image transferred thereto. An aperture 14 is present between the right-hand extension 11 of corotron shield 8 and the main part of the cassette housing to enable the copy sheet to enter the cassette. The aperture 14 is in the form of a slot extending substantially the full width of the cassette and is relatively narrow, for example, 2 mm wide. Thus the slot is sufficiently wide to permit a copy sheet to enter the cassette but narrow enough to provide appreciable protection for the photoreceptor from damage, contamination, and light exposure, thus prolonging the useful life of the photoreceptor.

The path which a copy sheet follows as it passes through the cassette for image transfer purposes is denoted by arrow 22 in FIG. 2. The external wall portion 15 of the main part of the cassette housing is shaped so as to deflect and guide the approaching copy sheets towards the aperture 14. Furthermore, the extreme right-hand side of the extended portion 11 of corotron shield 8 has a downturned lip 16 inclined obtusely relative to the adjacent plateau portion 17. The downturned lip 16 thus also acts to guide approaching copy sheets towards the aperture 14.

As the copy sheet enters the cassette it follows the path defined between the photoreceptor belt 3 and the plateau portion 17 of the corotron shield extension 11 which thus acts as a paper guide.

Figure 3:
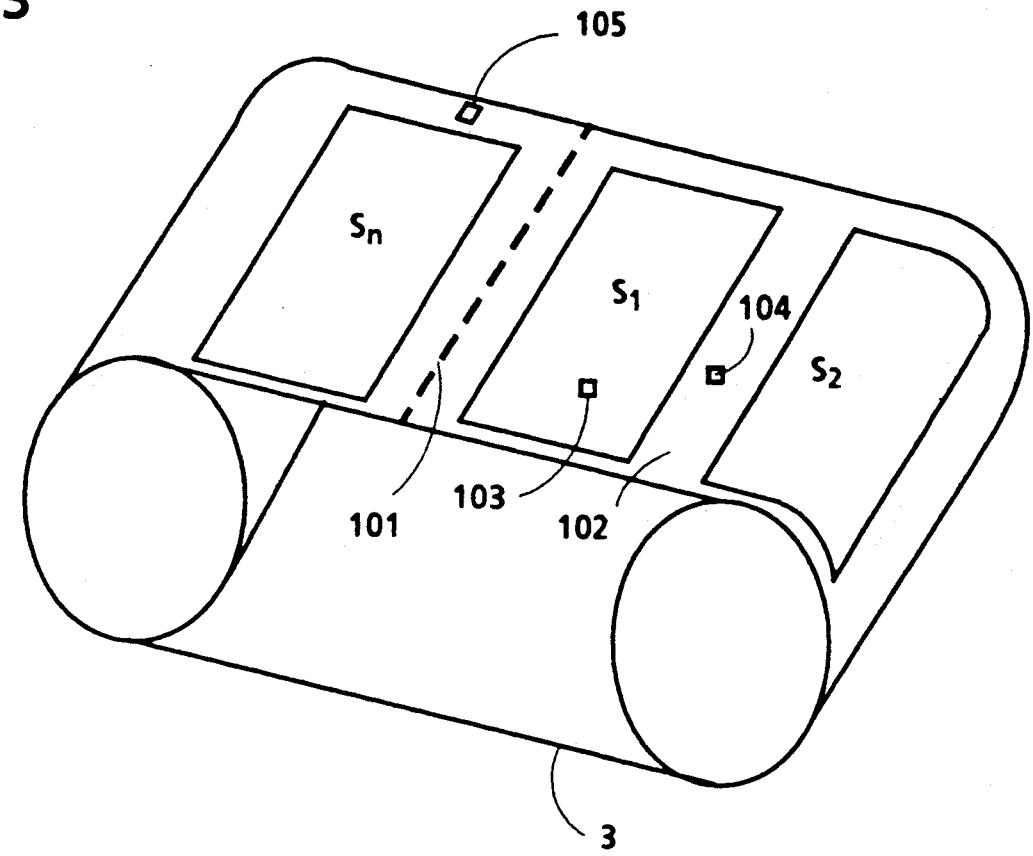
FIG. 3 is a diagrammatic isometric view of a belt photoreceptor of an electrophotographic apparatus in accordance with the invention.
Figure 5:
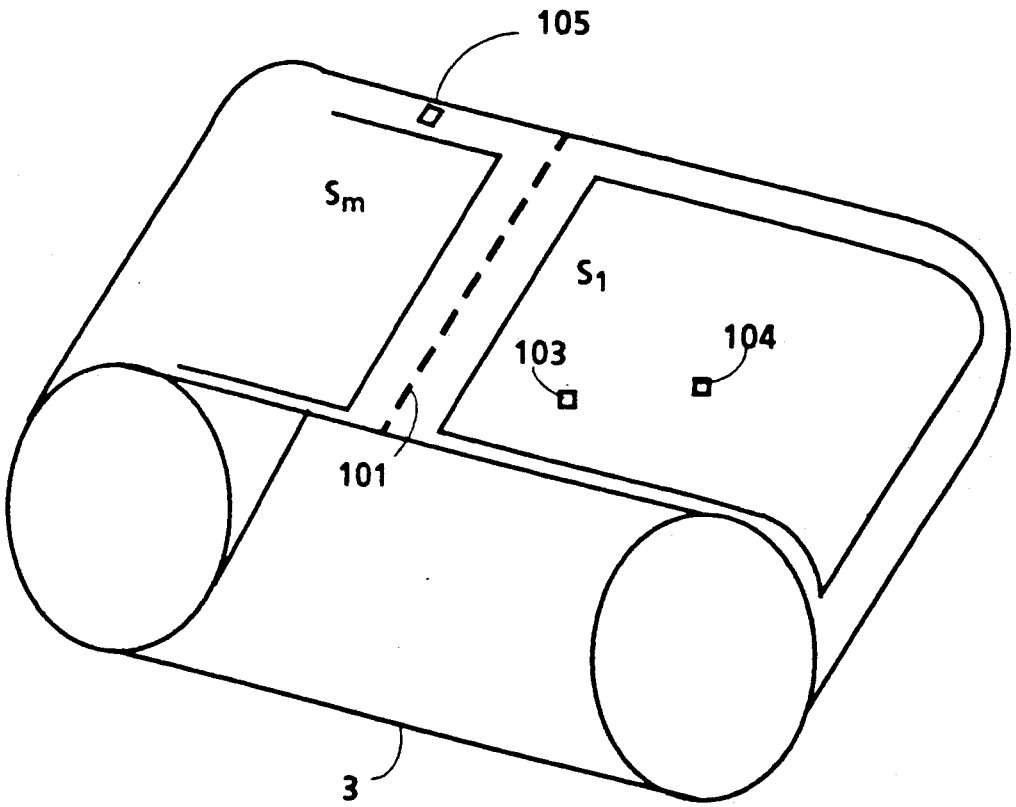
FIG. 5 is a view corresponding with FIG. 3, but in which the photoreceptor is being used for different sized images.

The photoreceptor belt 3 of the cassette shown in FIG. 2, and shown in more detail in FIG. 3, has a number (n) of imaging sections $S_1$, $S_2$, . . . $S_n$ around its length. In other words, there are n separate, identifiable, non-overlapping belt sections on each of which an electrostatic latent image is formed during the electrophotographic imaging process. The belt sections are arranged to avoid the seam line 101, and are separated by non-image areas 102. In FIG. 3, it is assumed that the images are all of a standard size, such as A4. For larger images, such as A3 images, a smaller number of belt sections (e.g. $S_1$-$S_m$, as shown in FIG. 5) are accommodated around the belt.

Figure 4:
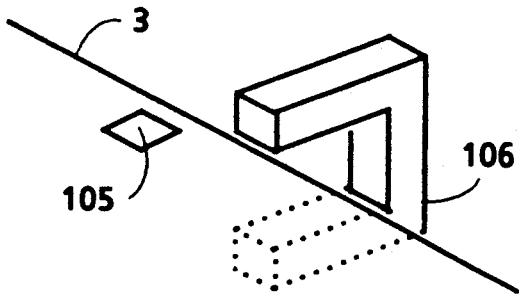
FIG. 4 is a diagrammatic representation of an optical sensor used to detect a synchronizing mark on the belt photoreceptor of FIG. 3.

An optically recognizable synchronizing mark, such as a hole 105, is provided in the belt 3, along the border of the belt outside the imaging area, so that the control system of the machine can identify the portion of the belt being processed at any given time, and avoid the seam line 101. The belt hole 105 is detected by an optical sensor 106 (FIG. 4), which produces an electrical signal on detection of the hole to start a timing sequence. The belt sections $S_1$-$S_n$ are defined by allocating time bands within the time taken for a single complete revolution of the belt 3.

Examples of copying machines using belt photoreceptors having a synchronizing hole to enable the seam in the belt to be avoided when forming electrostatic images on the belt are the Xerox 5046 and the Xerox 1075.

If a defect 103 is present, or develops, on an imaging section of the photoreceptor belt, it will become apparent on every nth copy produced by the machine. When the user notices such a repeating image defect in the output copies produced by the apparatus a defect location routine can be selected in the control system which will make sufficient images to cover the entire circumference of the photoreceptor. The source of these images will depend upon the type of device containing the apparatus:

If the device is a copier which does not have the capability of generating electrostatic images internally (i.e. separately from images derived from input documents), the user may place an original, on which the defect was visible, on the platen glass or may place a numbered set of these originals in a document feeding device.

If the device is a printer capable of generating images internally, such as a laser printer, or a copier with the capability of generating electrostatic images internally, the user may select a test image likely to show the defect (e.g. blank or uniform gray). In addition, any device with internal image creation capability may print numbers on the test image areas to facilitate identification.

When the user examines the set of test output images, the number of the defective image in the sequence may be determined either by counting or by a number printed on it. The user can then input the number of the defective area via a keyboard or other user interface to the machine control system. This data will be used by the control system to inhibit image formation in the identified belt section(s) until the instruction is countermanded.

If the device containing the imaging module is a printer with a digital scanner, the test images may be fed through the scanner to compare the output images with the input images and thus identify defective images automatically. Images from electrophotographic printers are often formed from discrete 'pixels' of constant area. A test image may be output which contains a known number of pixels per unit area (gray) or no pixels per unit area (white). A device for generating a uniformly gray test image on photoreceptor belt 3 is indicated as 200 in FIG. 1. If the test iamge is passed through a digital scanner, the number of pixels per unit area on the test print may be compared electronically with the known number of pixels per unit area used during the formation of the latent image. If this number is greater or less than the known number of image pixels, the presence of a defect will be indicated. Threshold values may be selected for these differences in pixels counts to avoid the indication of insignificant defects.

For an electrophotographic printer which does not form 'pixel' images the comparison between the areas of the input and output images may be made in a similar way.

Suppose, for example, a defect exists on belt section $S_2$ and image formation is inhibited in this area after using the defect location routine. When the machine is activated, section $S_1$ will be charged normally, and an electrostatic latent image will be formed, developed and transferred to a paper sheet as described earlier. When belt section $S_2$ arrives at the start of the image formation cycle, the charging unit 114 will be turned off so that no latent image is formed at 116 and no toner is deposited at development station 118. The next sheet of paper waiting to receive a developed image will be held at rolls 136 while section $S_2$ passes the transfer station 120. Belt sections $S_3$ to $S_n$ will then be imaged and developed normally. This sequence will be repeated for each complete rotation of the photoreceptor belt.

Examples of typical defect location routines for a copier and a printer respectively are shown in the following Tables 1 and 2:

TABLE 1

| Procedure | Copier<br>Instructions to user<br>(via display or user interface) |
|---|---|
| Repetitive defect noted on imaged output | |
| Select defect location routine via keypad or user interface | Place test original on copy glass or load n documents numbered 1 to n in document handler.<br>Press START to continue |
| Take set of test images from device output | |
| Identify number of the defective copy in the set | Enter number of defective copy in test set |
| User enters defective image number via keypad or user interface | Defective image disabled.<br>Press CLEAR to exit or START to run additional test set |
| Exit defect identification routine or run additional test set to confirm that correct image is disabled | |

TABLE 2

| Procedure | Printer<br>Instructions to user<br>(via display or user interface) |
|---|---|
| Repetitive defect noted on imaged output | |
| Select defect location routine via keypad or user interface | Select WHITE or GRAY test image<br>Press START to continue |
| Take set of test images from device output | |
| Identify number of the defective copy in the set | Enter number of defective copy in test set |
| User enters defective image number via keypad or user interface | Defective image disabled.<br>Press CLEAR to exit or START to run additional test set |
| Exit defect identification routine or run additional test set to confirm that correct image is disabled | |

forming areas which are not used when copying standard sized images (e.g. A4). When larger sized images are made, however. A3), these areas may be utilized, as shown in FIG. 5. Thus if a defect 104 occurs in one of these areas 102, (e.g. it will not show on standard sized copies (FIG. 3), but will show on the larger copies (FIG. 5). If several image sizes are produced by the same apparatus, it will be necessary to define a defect location routine for each of the various image sizes if they use different areas of the photoreceptor surface.

I claim:

1. Electrophotographic apparatus, comprising:

an endless photoreceptor belt, the belt having at least two identifiable sections around its length on which electrostatic latent images are formed for subsequent development by toner particles and transfer of the toner image to output sheets;

a scanner for recording a latent image developable into a substantially uniformly grey test image;

means for scanning the output sheets produced by the test image recorded on each belt section; and means for disabling a defective belt section in response to said scanning means determining that the belt section has a defect with a size greater than a predetermined threshold size.

2. The apparatus of claim 1, further comprising:

means for identifying a datum position on the belt: and means for causing the apparatus to operate in a test mode wherein one output sheet is produced for each of said belt sections, starting with a belt section in a predetermined position relative to said datum position, whereby the defective belt section can be identified.

3. The apparatus of claim 2, further comprising means for causing said output sheets made in said test mode to be marked with a sequence of identifying indicia.

4. The apparatus of claim 3, further comprising a user interface for disabling the defective belt section by selecting a disabling function and entering the identifying index of the defective belt section.

5. The apparatus of claim 1, further comprising means for disabling defective belt sections for each of a plurality of different image sizes.

6. In an apparatus in which electrostatic latent images are formed on an endless photoreceptor belt for subsequent development by toner particles and transfer of the toner image to output sheets, the belt having at least two identifiable sections around its length on which said images are formed, a method for avoiding defects in the toner image, comprising the steps of:

forming a latent image on each section, developable into a substantially uniformly grey test image on a test output sheet;

identifying a defective belt section by optical inspection of each test output sheet; and preventing the formation of images on the defective section, so that a defective belt section may be disabled, while allowing images to be formed on the non-defective belt section.

7. The method of claim 6, wherein each belt section is identified by an index, and the defective belt section is disabled by entering the index of the defective belt section through a user interface of the apparatus.

8. The method of claim 6, wherein the defective belt section is identified by optically comparing at least an area of an input image used to create the latent image with a corresponding area on an output sheet.

9. The method of claim 8, wherein the defective belt section is identified by detecting a difference in the number of pixels of a preselected type between an area on an output sheet and an equivalent area in a scanner output creating the latent image.

* * * * *